US008151618B2

(12) United States Patent
Polofsky

(10) Patent No.: US 8,151,618 B2
(45) Date of Patent: Apr. 10, 2012

(54) PEX CRIMP TOOL WITH CRIMPING INSERT RELEASE

(75) Inventor: Jeffrey Alexander Polofsky, Matthews, NC (US)

(73) Assignee: Conbraco Industries, Inc., Matthews, NC (US)

( * ) Notice: Subject to any disclaimer, the term of this patent is extended or adjusted under 35 U.S.C. 154(b) by 7 days.

(21) Appl. No.: 12/861,237

(22) Filed: Aug. 23, 2010

(65) Prior Publication Data

US 2012/0042710 A1 Feb. 23, 2012

(51) Int. Cl.
*B21D 39/04* (2006.01)

(52) U.S. Cl. ..... 72/409.16; 72/409.01

(58) Field of Classification Search ..... 72/409.01, 72/409.11, 409.16, 409.13, 402; 29/237; 81/421–423

See application file for complete search history.

(56) References Cited

U.S. PATENT DOCUMENTS 6,772,618 B2 * 8/2004 Frenken ..... 72/409.16
2002/0056308 A1 * 5/2002 Frenken ..... 72/409.16

* cited by examiner

*Primary Examiner* — Faye Francis
(74) *Attorney, Agent, or Firm* — Shumaker, Loop & Kendrick, LLP

(57) ABSTRACT

A crimp tool including first and second handles pivotally connected to first and second jaw members, respectively, first and second crimping inserts engaging the first and second jaw members, respectively, each of the first and second crimping inserts having a catch protruding from a non-crimping surface thereof, and first and second hooks slidably attached to the first and second jaw members, respectively, the first and second hooks releasably engaging the protruding catches to retain the crimping inserts on the jaw members.

9 Claims, 8 Drawing Sheets

PEX CRIMP TOOL WITH CRIMPING INSERT RELEASE

TECHNICAL FIELD AND BACKGROUND OF THE INVENTION

1. Field of the Invention

The present invention relates generally to the field of tools configured for use with cross-linked polyethylene ("PEX") tubing and accessories, and more particularly, to a PEX crimp tool for compressing crimp rings including spring-biased crimping insert retainers for readily interchanging insert sizes without the need for tools.

2. Background of the Invention

Known to those skilled in the art, PEX tubing is commonly used in plumbing applications as an alternative to polyvinylchloride ("PVC") and copper pipe. Uses of PEX tubing include general plumbing applications, hydronic radiant heating systems, water piping and insulation systems, and the general transportation of fluids and slurries, among other uses.

In a specific application, a crimp ring may be used at a fitting shoulder location to achieve a leak-free, quality joint. Specifically, at a fitting shoulder location, a crimp ring may be positioned a predetermined distance from an end of a pipe, for example about ⅛"-¼" from the end of the pipe, and directly over two end ribs of the fitting. When in place, the crimp ring is then evenly compressed over the pipe using a crimping tool that uniformly compresses the PEX material between the ribs, resulting in the leak-free quality joint.

While PEX crimp tools having interchangeable insert sizes are known in the art, such as ½", ¾" and 1" diameter sizes, conventional tool designs typically include retaining bolts or screws for retaining the inserts on the tool, consequentially requiring proper tightening to prevent unintentional insert separation and requiring a separate tool (e.g. crescent wrench) for manipulating the bolts. Accordingly, to overcome the disadvantages of the prior art tools and provide a user-friendly tool design, a PEX crimp tool is provided having an integrated insert release that prevents an insert from being unintentionally separated from the tool and allows inserts to be interchanged without the need for a separate tool.

BRIEF SUMMARY OF THE INVENTION

Accordingly, to overcome the disadvantages of prior art tool designs, in one aspect an adjustable PEX crimp tool is provided having a toolless insert release feature for readily interchanging crimping inserts.

In another aspect, the tool includes first and second handles operationally connected to first and second jaw members, respectively, wherein opening and closing of the handles causes simultaneous opening and closing of the jaw members, however to a lesser degree.

In another aspect, the first and second jaw members each define a first end pivotally connected to their respective handle and a second free end retaining a removable crimping insert.

In another aspect, the first and second handles are interconnected at one end at a common pivot point, the first and second jaw members are pivotally connected about their first end to their respective handle, and the first and second jaw members are independently pivotally interconnected through a common jaw connector.

In another aspect, each jaw member defines a recess for seating its respective crimping insert, and crimping inserts are brought together to cooperatively define a cylindrical crimping surface of a predetermined diameter.

In another aspect, the insert release feature includes independently moveable spring-biased hooks that engage catches of the crimping inserts.

In another aspect, interchanging crimping inserts involves sliding the hooks from a first position of engagement with the catches of a first set of inserts to a second position out of engagement with the catches, removing the first set of inserts, maintaining the hooks in the second position, inserting a second set of inserts, and allowing the spring to return the hooks to the first position to engage the hooks with the catches of the second set of inserts.

To achieve the foregoing and other aspects and advantages, a PEX crimp tool is provided herein including first and second handles pivotally connected, first and second jaw members pivotally connected to the first and second handles, respectively, first and second crimping inserts engaging the first and second jaw members, respectively, each of the first and second crimping inserts having a catch protruding from a non-crimping surface thereof, and first and second hooks slidably attached to the first and second jaw members, respectively, the first and second hooks releasably engaging the protruding catches of the first and second crimping inserts, respectively, to retain the first and second crimping inserts on their respective jaw member.

In a further embodiment, the first and second hooks are spring-biased in a direction of the first and second handles.

In a further embodiment, each of the first and second hooks include a housing defining an elongate slot therethrough receiving a fastener therethrough slidably attaching the hook to its respective jaw member.

In a further embodiment, the crimp tool further includes a spring positioned intermediate the housing and the fastener biasing the hook in a direction of the first and second handles.

In a further embodiment, the first and second hooks when engaged with their respective catch urge their respective crimping insert toward their respective jaw member.

In a further embodiment, the catch of each of the first and second crimping inserts protrudes from a side of its respective crimping insert.

In a further embodiment, the first and second crimping inserts when engaged cooperatively define a cylindrical crimping surface.

In a further embodiment, each of the first and second jaw members are pivotally connected at a first end to their respective handle and are pivotally connected to the jaw connector at about their mid-span.

In another embodiment, the present invention provides a method for interchanging crimping inserts of a crimp tool, the method including providing a crimp tool including a handle pivotally connected to a jaw member, a first crimping insert engaging the jaw member having a protruding catch carried on a non-crimping surface thereof, and a spring-biased hook slidably attached to the jaw member releasably engaging the protruding catch of the first crimping insert to retain the first crimping insert on the jaw member, sliding the hook from a first position of engagement with the catch of the first crimping insert to a second position out of engagement with the catch, and removing the first crimping insert from the jaw member.

In a further embodiment, the method includes providing a second crimping insert having a crimping diameter different from a crimping diameter of the first crimping insert, moving the hook to the second position, engaging the second crimping insert with the jaw member, and returning the hook to the first position whereby the hook engages a catch of the second crimping insert.

In a further embodiment, the hook is spring-biased in a direction of the handle.

In a further embodiment, the hook includes a housing defining an elongate slot therethrough receiving a fastener therethrough slidably attaching the hook to the jaw member.

In a further embodiment, the crimp tool includes a spring positioned intermediate the housing and the fastener biasing the hook in a direction of the handle such that when the hook is engaged with the catch the crimping insert is urged toward the jaw member.

Additional features and advantages of the invention will be set forth in the detailed description which follows, and in part will be readily apparent to those skilled in the art from that description or recognized by practicing the invention as described herein.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION OF THE INVENTION

The present invention will now be described more fully hereinafter with reference to the accompanying figures in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention.

Figure 1:
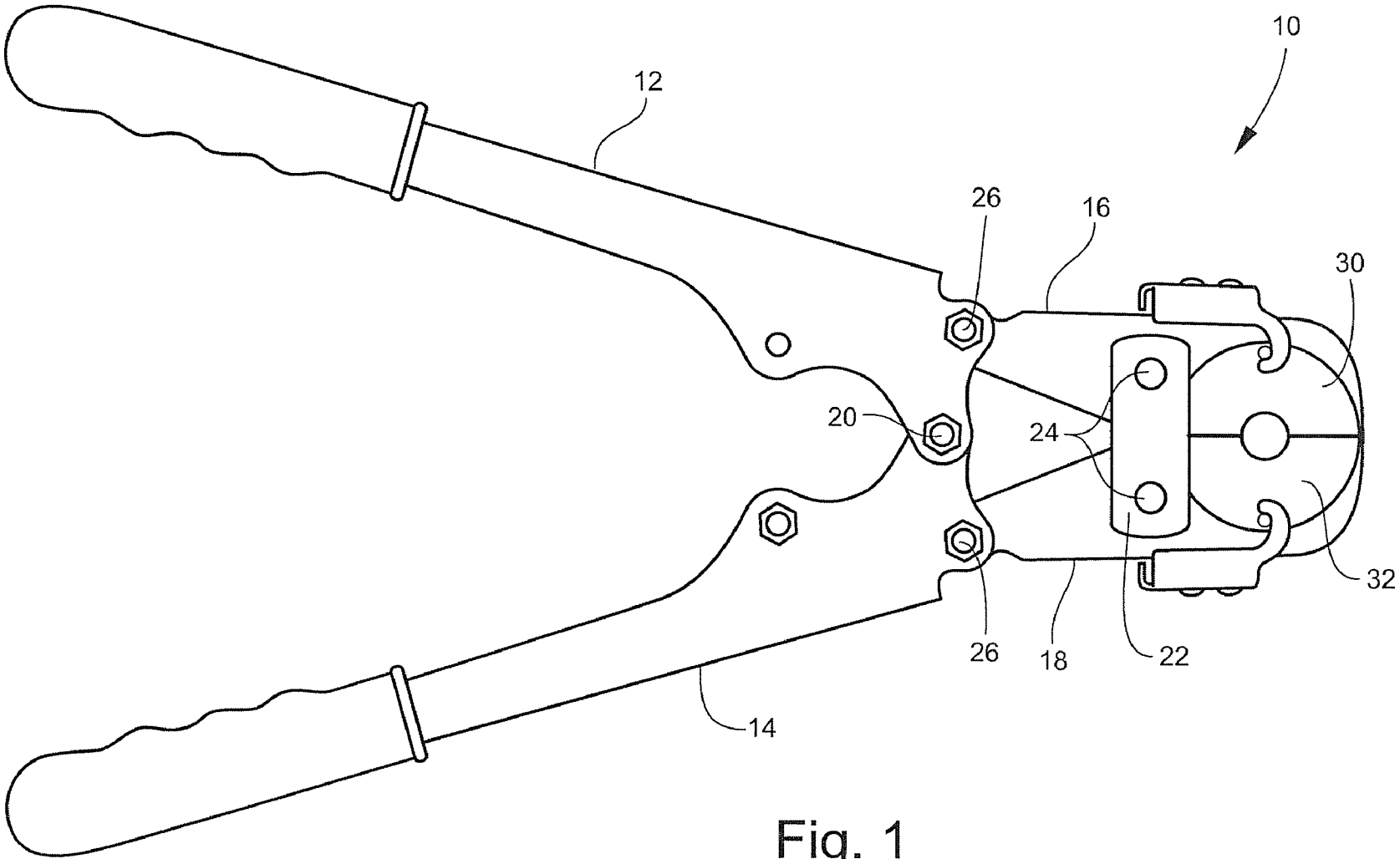
FIG. 1 is a plan view of the PEX crimp tool including an integrated crimping insert release feature.
Figure 2:
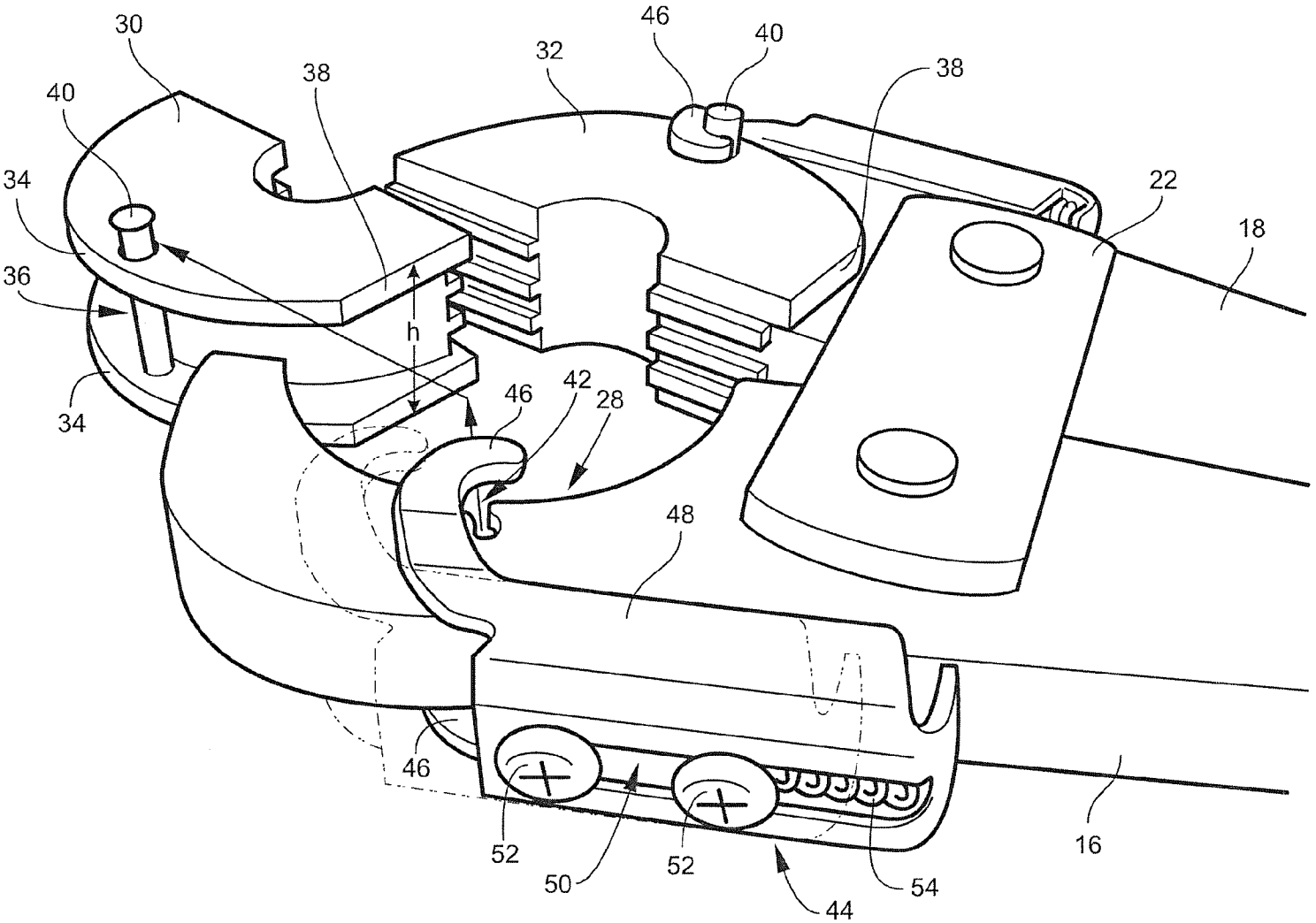
FIG. 2 is a detailed perspective view of the crimp tool of FIG. 1 showing the structural details of the crimping insert and the integrated crimping insert release feature.

Referring to the figures, an adjustable PEX crimp tool having interchangeable crimping inserts for evenly compressing a crimp ring in a radial direction is provided herein and is shown generally at reference numeral 10. Referring specifically to FIGS. 1-2, the crimp tool 10 generally includes first and second handles 12, 14 operationally connected to first and second jaw members 16, 18, respectively, wherein opening and closing of handles 12, 14 causes simultaneous opening and closing of jaw members 16, 18, however to a lesser degree. First and second handles 12, 14 are pivotally interconnected at common pivot 20.

First and second jaw members 16, 18 are pivotally connected about their first end to their respective handle, and are independently pivotally connected to a common jaw connector 22. Thus, first and second jaw members 16, 18 are each pivotally connected to jaw connector 22 at pivot points 24 to allow law members 16, 18 to pivot relative thereto in response to movement of the first and second handles 12, 14. Jaw connector 22, with one jaw connector preferably provided on each "side" of tool 10, holds the first and second jaw members 16, 18 together and prevents lateral displacement with respect thereto. Each of jaw members 16, 18 terminate at a first end in a pivotal connection with its respective handle at pivot 26, and define proximate a second end recess 28 for receiving a crimping insert 30, 32.

Each of crimping inserts 30, 32, define a portion (i.e. approximately one-half) of a cylindrical crimping surface, and cooperatively define a crimping surface having a predetermined diameter, for example ½", ¾" or 1". Crimping insert diameter size is chosen dependent upon application and insert sizes are interchangeable. Crimping inserts 30, 32 each define flanges 34 or "shoulders" on opposing sides thereof defining a channel 36 therebetween for receiving the jaw member therein. Flanges 34 are generally annular, however define a flat spot 38 positioned adjacent jaw connector 22 such that flat spot 38 engages a sidewall of jaw connector 22 flush when jaw members 16, 18 are in the "closed" configuration (i.e. handles 12, 14 are closed). The shape of recess 28 preferably complements the shape of channel 36 to provide tight-fitting, flush engagement therebetween.

Crimping inserts 30, 32 each further include catch 40 axially traversing the height "h" or thickness of crimping inserts 30, 32 and protruding a predetermined distance beyond both sides of the inserts defined by opposing annular flanges 34. Thus, catch 40 protrudes outwardly beyond the surface of the non-crimping surfaces of its respective crimping inserts. As shown, catch 40 is generally a rod received through aligned openings defined through opposing flanges 40, spans channel 36, and terminates at opposing ends in an enlarged head to prevent withdrawal. When engaged, the portion of catch 40 spanning channel 36 is received within complimentary shaped catch recess 42 defined in jaw member recess 28. The inclusion of both catch recess 42 and flat spot 38 ensures correct installation orientation of the crimping insert with its respective jaw member.

Crimp tool 10 further includes an integrated crimping insert release feature that obviates the need for a separate tool (e.g. wrench, screwdriver) to remove a crimping insert. The integrated release feature is shown generally at reference numeral 44 and includes at least one hook 46, and preferably a pair of hooks disposed on opposing sides of its respective jaw member, slidingly attached to its respective jaw member such that the hook translates with respect to the jaw member to engage and disengage catch 40 of a crimping insert.

As shown, integrated release feature 44 specifically includes a housing 48 defining an elongate slot 50 therethrough receiving at least one fastener 52 therethrough for slidingly attaching the housing 48 to its respective jaw member. Hooks 46 are carried on the end of housing 48 opposite the handle. Hooks 46 extend from housing 48 and engage catch 40 such that crimping insert 30, 32 cannot be withdrawn from recess 28 when hook 46 and catch 40 are engaged, thus preventing unintentional separation of a crimping insert from its respective jaw member.

Integrated release feature 44 further includes a spring 54 trapped within housing 48 and disposed intermediate one end of housing 48 and fastener 52 operable for biasing hook 46 in the direction of the handle. As shown, two fasteners 52 are included, a first for providing a mechanical stop for limiting travel of housing 48 in the direction toward the handle, and the second for limiting the travel of housing 48 in the direction away from the handle. The degree of travel required of hook 46 provided by the fastener/slot arrangement is only that sufficient to clear catch 40 to disengage and withdraw the crimping insert from its respective jaw member, and to engage catch 40 with force present from spring 54. Integrated release feature 44 is preferably manipulated by hand with low force.

Referring again to tool 10, first and second handles 12, 14 are brought together to "close" crimping inserts 30, 32, i.e. bring them together, and pulled apart to "open" crimping inserts 30, 32. A crimping insert may be interchanged with one of another size, pattern, etc. when handles 10 are in the open configuration.

Referring to FIGS. 3-8, a method for interchanging crimping inserts of a crimp tool having an integrated crimping insert release feature 44 is provided herein. As used herein, the term "first crimping insert" is intended to describe a crimping insert having a first functional diameter, for example ½", and the term "second crimping insert" is intended to describe a crimping insert having a functional diameter different from the first crimping insert, for example ¾". Thus, the method for interchanging a crimping insert is described herein with reference to these particular insert sizes for exemplary purposes only, and the diameter sizes shown in FIGS. 3-8 are exaggerated for clarity of illustration in describing the method.

In one embodiment, the method for interchanging crimping inserts of a crimping tool having an integrated crimping insert release feature 44 first includes providing a crimp tool 10 comprising a handle 12 pivotally connected to a jaw member 16, a first crimping insert 30 engaging the jaw member 16 having a protruding catch 40 carried on a non-crimping surface thereof, and a spring-biased hook 46 slidably attached to the jaw member 16 releasably engaging the protruding catch 40 of the first crimping insert 30 to retain the first crimping insert 30 on the jaw member 16.

Figure 3:
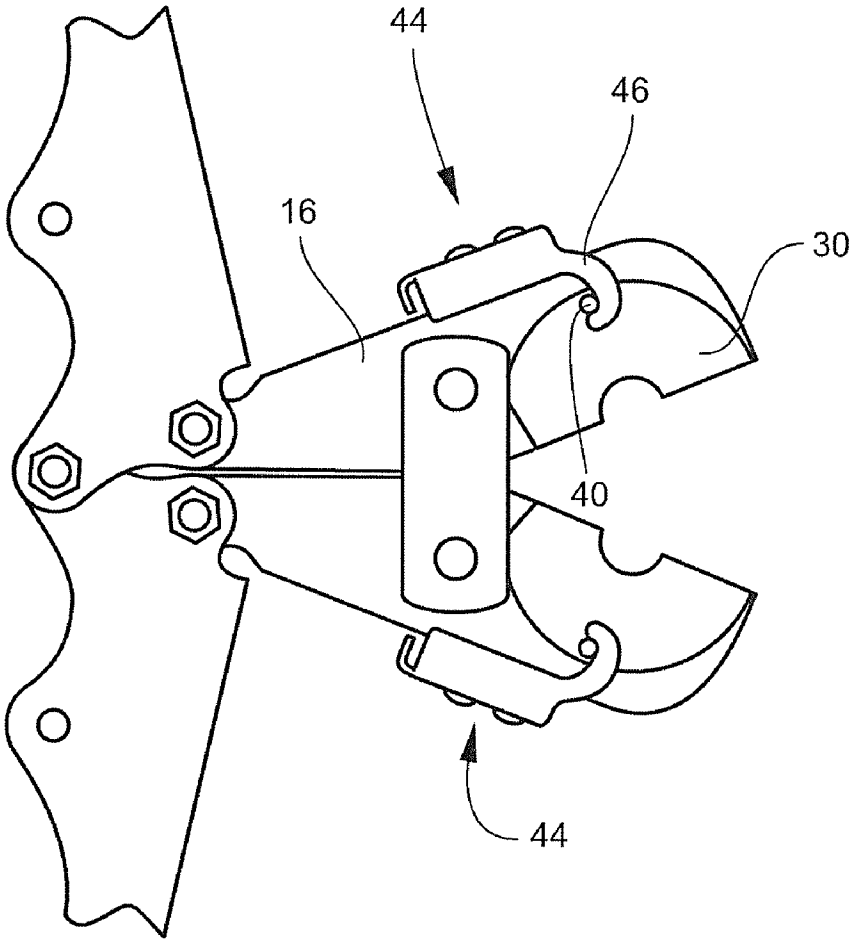
FIG. 3 is a detailed view of the jaw member portion of the crimp tool of FIG. 1 shown in the fully open configuration.
Figure 4:
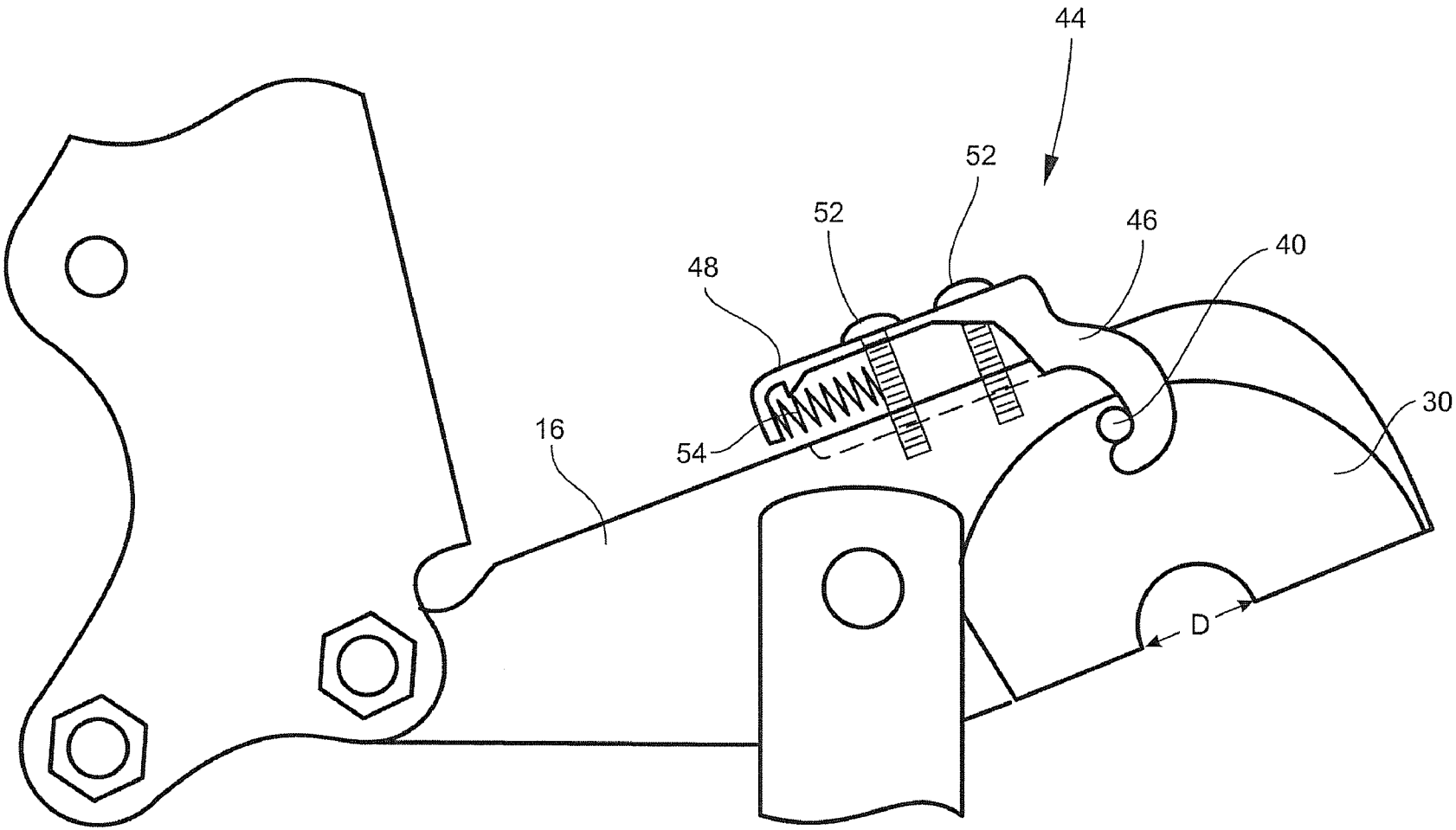
FIG. 4 is a detailed view of one jaw member of the crimp tool showing the crimping insert release feature engaged with a first crimping insert.
Figure 5:
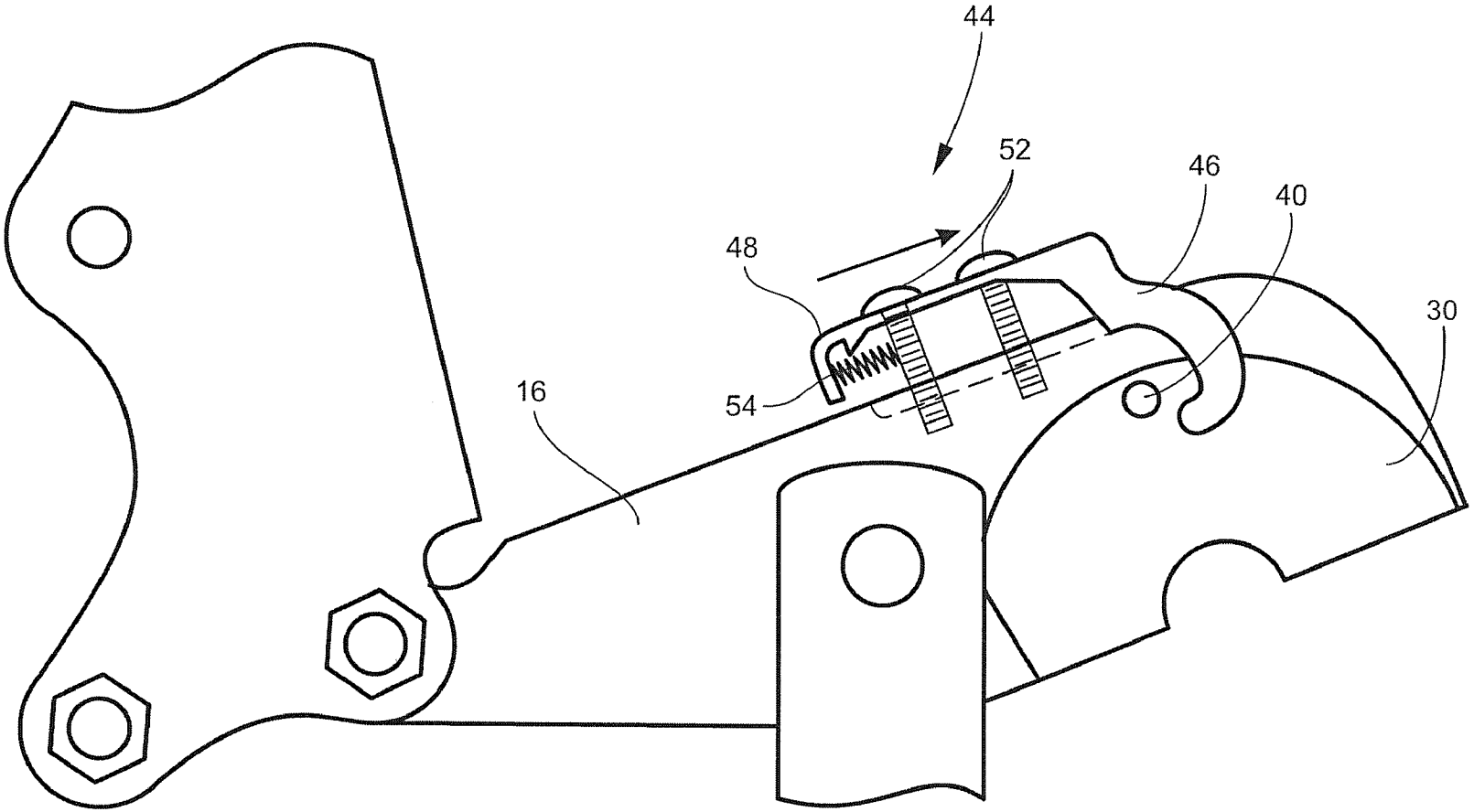
FIG. 5 is a detailed view of the jaw member of FIG. 4 showing the crimping insert release feature disengaged from the first crimping insert.
Figure 6:
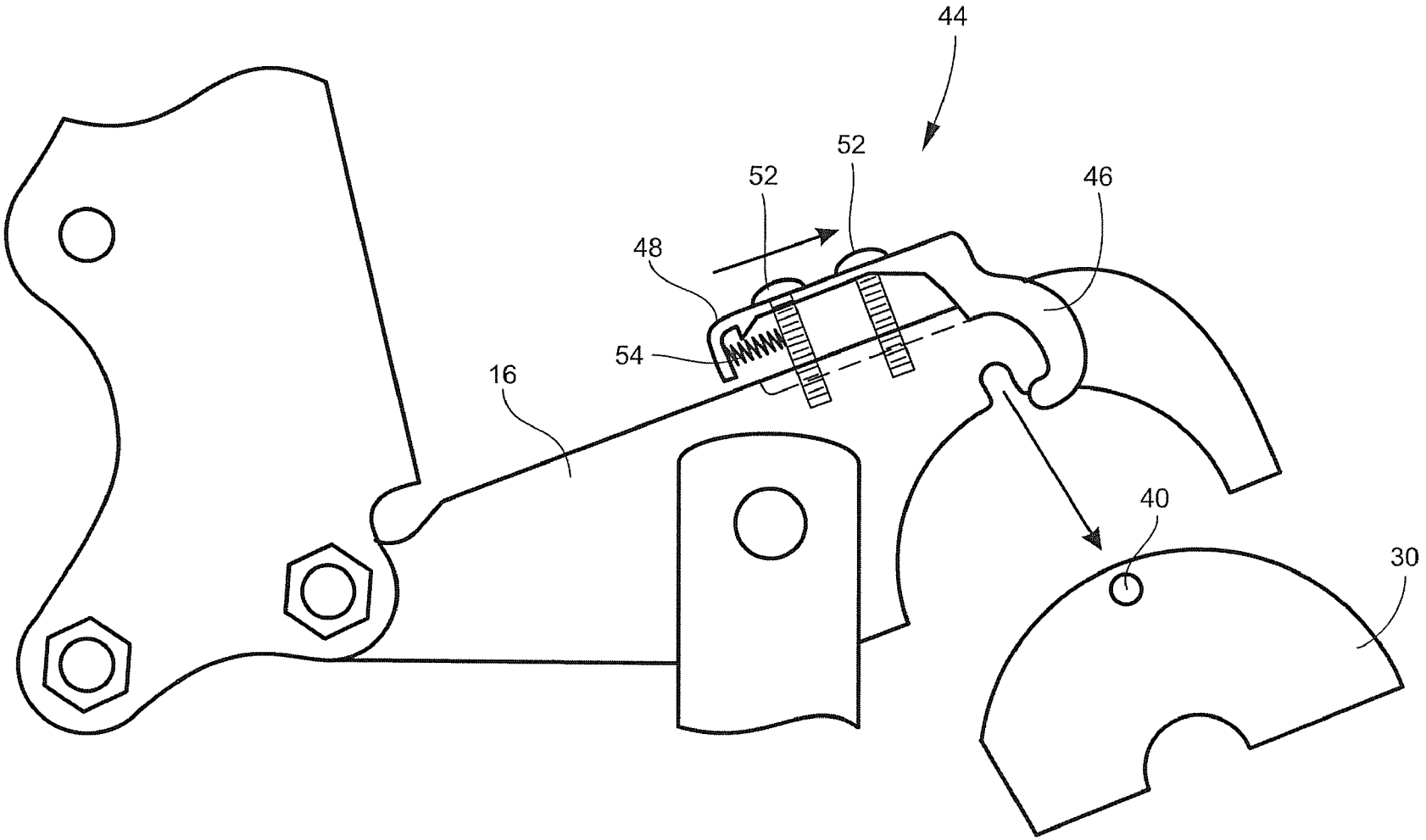
FIG. 6 is a detailed view of the jaw member of FIG. 4 showing the first crimping insert being separated from the jaw member.

The method next includes the step of opening tool 10 or verifying that tool 10 is open such that crimping insert 30 is not in contact with its opposing, corresponding crimping insert (see FIGS. 3 and 4). The method next includes the step of sliding hook 46 from a first position of engagement with catch 40 of first crimping insert 30 to a second position out of engagement with catch 40, thus "freeing" catch 40 from hook 46 (see FIG. 5). The next step of the method includes removing first crimping insert 30 from jaw member 16 (see FIG. 6).

Figure 7:
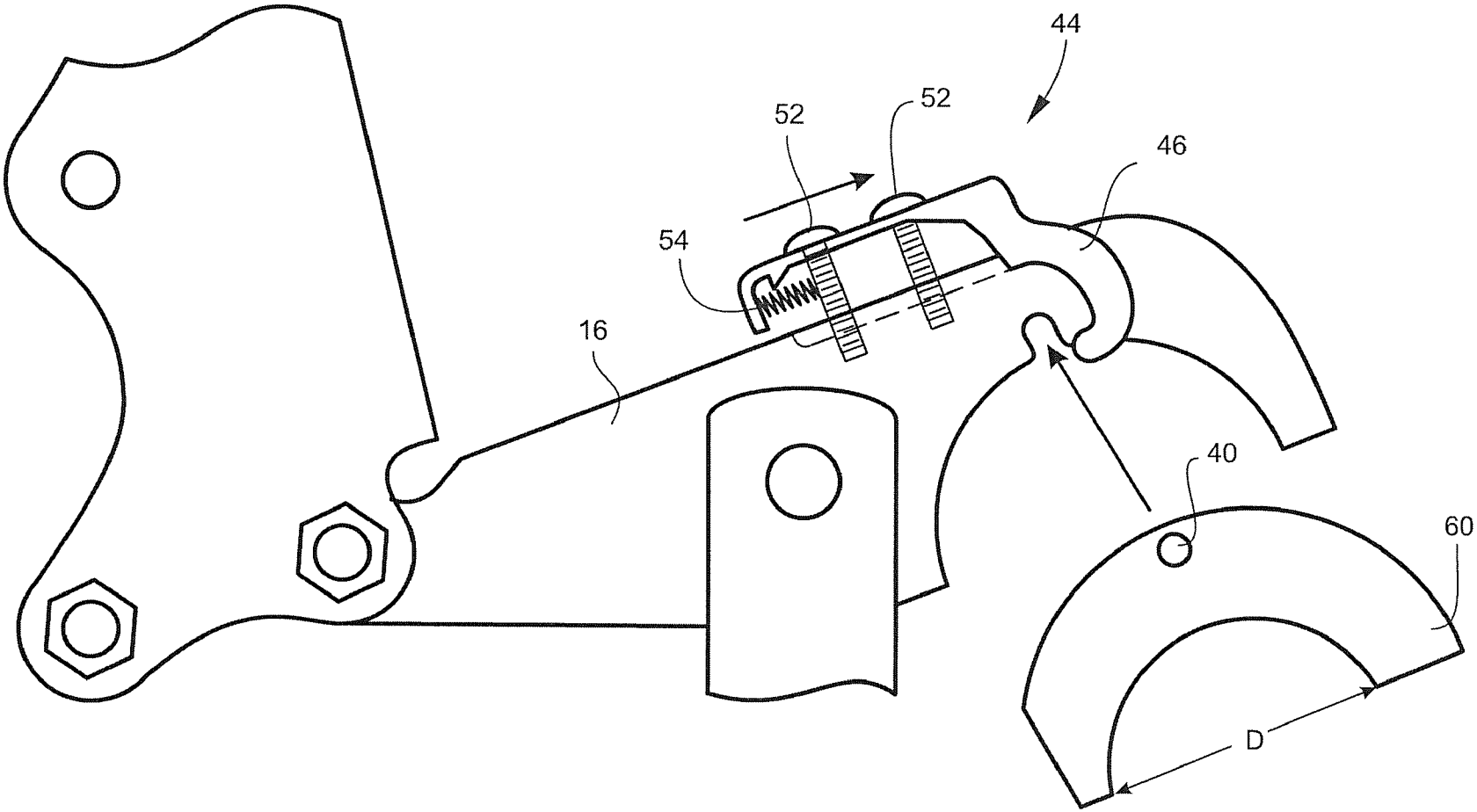
FIG. 7 is a detailed view of the jaw member of FIG. 4 showing a second crimping insert being inserted into the jaw member.
Figure 8:
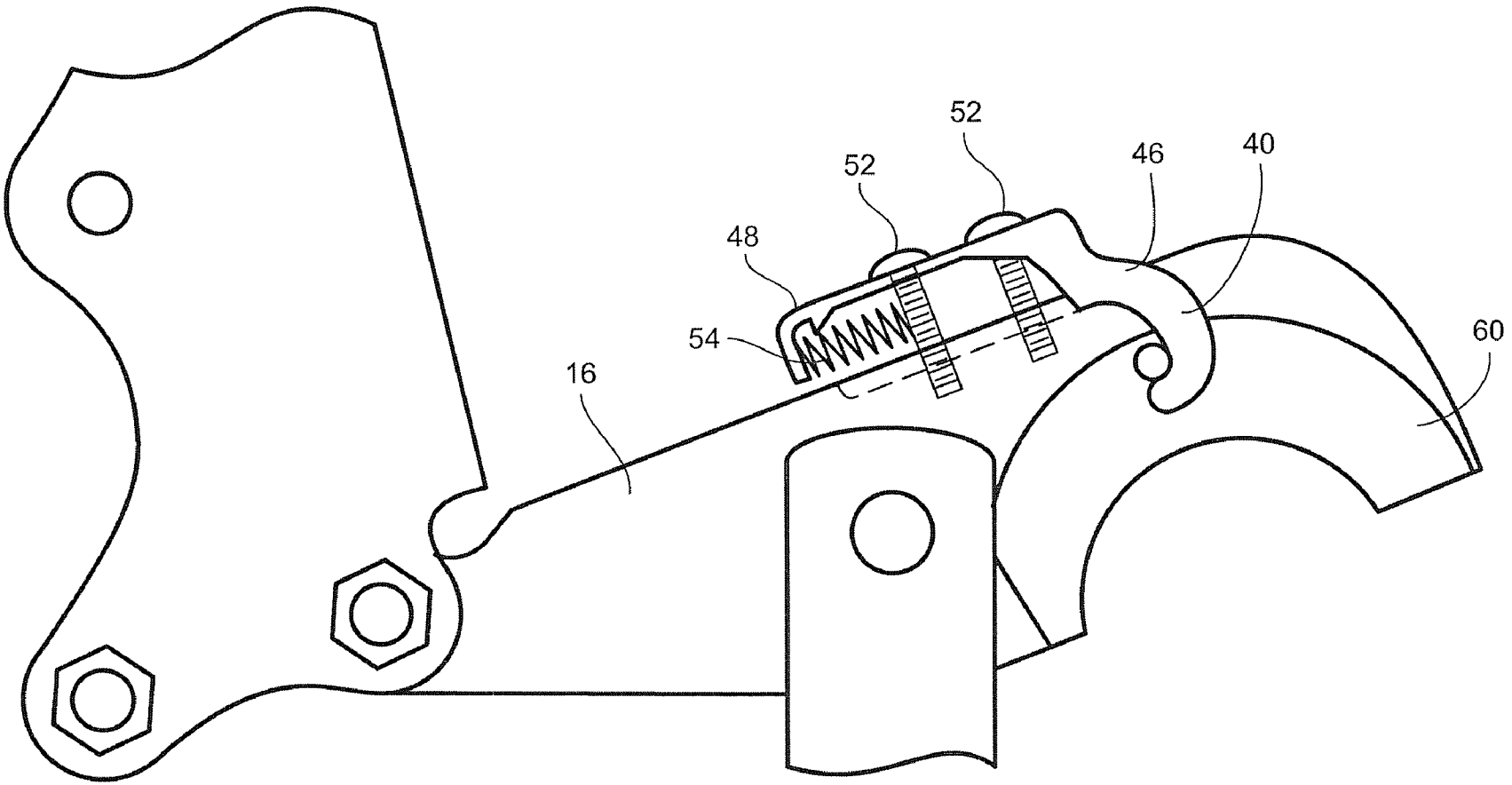
FIG. 8 is a detailed view of the jaw member of FIG. 4 showing the crimping insert release feature engaging the second crimping insert.

With jaw member 16 free of first crimping insert 30, the method further includes the step of providing a second crimping insert 60 having a crimping diameter "D" different from a crimping diameter "D" of first crimping insert 30 (see FIG. 7). With hook 46 in the second position, the method further includes the step of engaging second crimping insert 60 with the jaw member 16, and finally returning hook 46 to the first position whereby hook 46 engages catch 40 of second crimping insert 60. As hook 46 is biased in the direction of the handle, hook 46 moves from the second position to the first position merely by the return force provided by spring 54, and remains in the first position with hook 46 engaging catch 40 until hook 46 is purposely moved to the second position, thereby compressing spring 54.

While a PEX crimp tool and method for interchanging crimping inserts have been described herein with reference to specific embodiments and examples, it is envisioned that various details of the invention may be changed without departing from the scope of the invention. Furthermore, the foregoing description of the preferred embodiments of the invention and best mode for practicing the invention are provided for the purpose of illustration only and not for the purpose of limitation.

What is claimed is:

1. A crimp tool, comprising:

first and second handles pivotally connected;

first and second jaw members pivotally connected to the first and second handles, respectively;

first and second crimping inserts engaging the first and second jaw members, respectively, each of the first and second crimping inserts having a catch protruding from a non-crimping surface thereof; and first and second hooks slidably attached to the first and second jaw members, respectively, the first and second hooks releasably engaging the protruding catches of the first and second crimping inserts, respectively, to retain the first and second crimping inserts on their respective jaw member.

2. The crimp tool according to claim 1, wherein the first and second hooks are spring-biased in a direction of the first and second handles.

3. The crimp tool according to claim 1, wherein each of the first and second hooks comprise a housing defining an elongate slot therethrough receiving a fastener therethrough slidably attaching the hook to its respective jaw member.

4. The crimp tool according to claim 3, further comprising a spring positioned intermediate the housing and the fastener biasing the hook in a direction of the first and second handles.

5. The crimp tool according to claim 1, wherein the first and second hooks when engaged with their respective catch urge their respective crimping insert toward their respective jaw member.

6. The crimp tool according to claim 1, wherein the catch of each of the first and second crimping inserts extends through a height of its crimping insert and protrudes from both sides of its crimping insert.

7. The crimp tool according to claim 1, wherein the first and second crimping inserts when engaged cooperatively define a cylindrical crimping surface.

8. The crimp tool according to claim 1, wherein each of the first and second jaw members are pivotally connected at a first end to their respective handle and are pivotally connected to the jaw connector at about their mid-span.

9. The crimp tool according to claim 1, wherein closing of the first and second handles causes simultaneous closing of the first and second crimping inserts.

* * * * *